US010260730B2

(12) United States Patent
Kovalchick et al.

(10) Patent No.: US 10,260,730 B2
(45) Date of Patent: Apr. 16, 2019

(54) LED LUMINAIRE LIGHT FIXTURE FOR A LAMPPOST

(71) Applicant: Spring City Electrical Mfg. Co., Spring City, PA (US)

(72) Inventors: Daniel Kovalchick, Sinking Spring, PA (US); Bryan Rash, Pottstown, PA (US); Michael Greck, Spring City, PA (US); Alan Brink, Radnor, PA (US)

(73) Assignee: Spring City Electrical Mfg. Co., Spring City, PA (US)

( * ) Notice: Subject to any disclaimer, the term of this patent is extended or adjusted under 35 U.S.C. 154(b) by 0 days.

(21) Appl. No.: 15/665,206

(22) Filed: Jul. 31, 2017

(65) Prior Publication Data

US 2017/0328553 A1 Nov. 16, 2017

Related U.S. Application Data

(63) Continuation of application No. 14/816,657, filed on Aug. 3, 2015, now Pat. No. 9,765,956.
(Continued)

(51) Int. Cl.
*F21V 29/76* (2015.01)
*F21S 8/08* (2006.01)
(Continued)

(52) U.S. Cl.
CPC ..... *F21V 29/76* (2015.01); *F21S 8/088* (2013.01); *F21V 29/83* (2015.01); *F21Y 2105/10* (2016.08);
(Continued)

(58) Field of Classification Search
CPC ... F21S 8/085–8/088; F21W 2131/103; F21W 2111/02; F21W 2111/023
See application file for complete search history.

(56) References Cited

U.S. PATENT DOCUMENTS 4,719,548 A 1/1988 Orosz
6,682,211 B2 1/2004 English et al.
(Continued)

FOREIGN PATENT DOCUMENTS

CA 2744094 A1 12/2012

OTHER PUBLICATIONS

Cree, Inc., Cree XLamp XT Family LEDs, Cree Binning & Labeling, CLD-AP86 REV 8A, 2014, 27 pages.
(Continued)

*Primary Examiner* — Julie A Bannan
(74) *Attorney, Agent, or Firm* — Drinker Biddle & Reath LLP

(57) ABSTRACT

A mount for a light assembly in a luminaire has a base section and mounting arms upstanding from the base section. Each mounting arm has an upward length and a width and has a lower portion and an upper portion. Mounting pads for light sources are unitary with or attached to the mounting arm upper portions and have an upward length and a width. The width of the mounting pads extends in a direction oblique to the width of the mounting arm lower portions. Preferably, the length of the mounting pads extends in a direction oblique to the length of the mounting arm lower portions. Light sources mounted on the mounting pads may emit beams of light directed obliquely away from each other and obliquely towards the base.

21 Claims, 4 Drawing Sheets

Related U.S. Application Data

(60) Provisional application No. 62/032,791, filed on Aug. 4, 2014.

(51) Int. Cl.
*F21V 29/83* (2015.01)
*F21Y 105/10* (2016.01)
*F21Y 115/10* (2016.01)
*F21Y 107/00* (2016.01)

(52) U.S. Cl.
CPC ..... *F21Y 2107/00* (2016.08); *F21Y 2115/10* (2016.08)

(56) References Cited

U.S. PATENT DOCUMENTS 6,955,451 B2 10/2005 Coushaine et al.
7,784,971 B2 8/2010 Dorogi
8,092,032 B2 1/2012 Pearse
8,104,929 B2 1/2012 Kovalchick et al.
8,109,660 B2 * 2/2012 Hochstein ..... F21K 9/00 362/373
8,262,261 B2 9/2012 Rossi
8,632,210 B2 1/2014 Hochstein
8,757,847 B2 6/2014 Seff et al.
2006/0193130 A1 8/2006 Ishibashi
2008/0192476 A1 * 8/2008 Hiratsuka ..... F21S 2/005 362/285
2009/0244896 A1 10/2009 McGehee et al.
2009/0268453 A1 * 10/2009 Pearse ..... F21V 7/0025 362/235
2011/0038154 A1 * 2/2011 Chakravarty ..... F21V 29/004 362/249.02
2011/0068708 A1 * 3/2011 Coplin ..... F21K 9/00 315/294
2011/0267820 A1 * 11/2011 Bansbach ..... F21S 8/088 362/249.02
2011/0310596 A1 12/2011 Ahmadi
2013/0320373 A1 * 12/2013 Pu ..... H01L 33/50 257/98
2014/0321126 A1 10/2014 Narag et al.
2015/0003058 A1 * 1/2015 Zhang ..... F21V 7/045 362/235
2015/0226382 A1 * 8/2015 Chien ..... F21K 9/23 362/382
2015/0252956 A1 9/2015 Carroll et al.
2015/0276145 A1 * 10/2015 Wang ..... F21S 8/04 362/235

OTHER PUBLICATIONS

Cree, Inc., Cree XLamp XT-E LEDs, Cree Product Family Data Sheet, CLD-DS41 REV 11B, 2014, 18 pages.
Cree, Inc., Cree XLamp XP-L LEDs, Cree Product Family Data Sheet, CLD-DS97 REV 1B, 2015, 14 pages.
Relume Retrofit Streetlight System UA/Two Piece Decorative Pole Top, Model Fixed-48, Jan. 2014, 2 pages.
Relume Retrofit Streetlight System UA/Two Piece Decorative Pole Top, Model Fixed-24 LED, Jan. 2014, 2 pages.

* cited by examiner

LED LUMINAIRE LIGHT FIXTURE FOR A LAMPPOST

CROSS REFERENCE TO RELATED APPLICATIONS

This application claims benefit of U.S. Provisional Patent Application No. 62/032,791 for an "LED Luminaire Light Fixture for a Lamppost," filed on Aug. 4, 2014, and a continuation of U.S. patent application Ser. No. 14/816,657, filed Aug. 3, 2015 titled "LED Luminaire Light Fixture for a Lamppost," the whole contents of both applications are incorporated herein by reference in their entirety.

FIELD OF THE INVENTION

The invention relates to the general field of LED lighting systems, and more specifically, to an LED luminaire fixture with a central mount for attaching to the top of a lamppost.

BACKGROUND OF THE INVENTION

Light Emitting Diodes ("LEDs") have several advantages for outdoor lighting over High Intensity Discharge ("HID") light sources, such as long life, lower energy consumption, durability, cold weather performance, directional orientation of beam patterns, instant on/off and controlled dimming without color change. In particular, the directional nature of an LED light source provides the ability to create asymmetric light beam emission patterns by orienting and directing multiple LED light engines that are mounted within the fixture in a specific direction. This eliminates the need to use reflectors and focusing lenses as in conventional light sources.

A major concern, however, when designing an LED outdoor fixture, is effective heat management. The heat that is generated at the semiconductor domain junctions is the primary determinant of the life of the LED and in maintaining a consistent wavelength. LEDs function better and last longer at cold or cool temperatures, and deteriorate more rapidly with increased heat. The design effort to draw heat away from the junctions has often resulted in the LED circuit boards being attached to a finned heat sink, with natural air convection or fans used for cooling. In an outdoor light fixture, however, the ambient temperature may at times be relatively high, even at night. There may also be little natural air movement in or around the fixture, especially in closed-dome fixtures, thus providing little ventilation within the fixture. As such, there is limited convective heat transfer.

In addition to the utilitarian design considerations, outdoor pole luminaries are often decorative pieces, mimicking ornate gas lanterns and early incandescent street and park lighting. Some of the fixture housings are very ornate and incorporate architectural design elements of the locale or historical periods. Replacing the light source in such fixtures with LED lighting is a particularly challenging task.

A major challenge in devising LED lighting fixtures is to ensure that the light from the LEDs is directed effectively and efficiently where it is desired. In particular, for street lighting, a light distribution pattern that extends along the street, and to a lesser extent out into the street, is often desired, with little or no light going back onto street-front properties behind the lamp or upwards.

One solution to such lighting challenges is described in U.S. Pat. No. 8,104,929 ("the '929 patent") which is directed to an outdoor lighting fixture that uses LEDs as a light source. The fixture includes a decorative housing with a cast metal dome roof having an inner surface and an outer surface. A plurality of LED light engines are provided, with each light engine containing a plurality of LEDs mounted on a circuit board, mounted on a conductive metal substrate. The substrate has a surface opposite the circuit board that is in conformal contact with a portion of the inner surface of the roof of the light fixture. The roof provides increased heat sink mass and the outer surface of the roof provides a heat dissipative surface area outside of the housing. Two of the LED light engines are placed along the inside walls of the dome roof, with one engine located at an acute angle to a line through the housing and the other engine at its complementary angle to the line, such that the light from the two LEDs is emitted in lobes that cross within the fixture and expand outside of it to create an asymmetric overall light profile.

While the design in the '929 patent provides a vast improvement over the prior art fixtures, there is still scope for a further improved fixture configuration that could be used with a center lamppost mounting system where lighting needs to be directed outward and downward, but not upward. A particular challenge is to provide a luminaire that can be used with an "acorn globe," which has a transparent top, and still comply with recent requirements to limit upward light emission.

SUMMARY

According to one embodiment, there is provided a mount for a light assembly in a luminaire, comprising a base section and a pair of mounting arms extending from the base section. The mounting arms have proximal portions that are generally flat and parallel and have each a length direction towards and away from the base and a width direction transverse to the length direction. The width directions of the mounting arm proximal portions may be generally parallel. The mounting arms have distal portions. Respective mounting pads for light sources are unitary with or attached to the mounting arm distal portions. The mounting pads have length directions towards and away from the base and width directions transverse to the length directions. The width directions of the mounting pads are oblique to one another, so that mounting surfaces of the mounting pads face obliquely away from each other.

The length directions of the mounting pads may be oblique to the length direction of the mounting arm proximal portions, so that the mounting pads face obliquely towards the base section. The mounting pads may be generally flat, and may have an array of facets for mounting an array of sources of light, with all of the facets angled in the same way relative to the general flatness of the mounting pad.

The mount may further comprise sources of light on the mounting pads, operative to direct light away from the mounting surfaces of the mounting pads.

The mount may be in combination with a lamp housing, wherein the mount is inside the housing.

The combined mount and lamp housing may be adapted for mounting on top of a lamppost, with the base of the mount attached to the lamppost and the mounting arms extending upwards from the base.

Another embodiment provides a luminaire comprising a housing that is at least partially transparent and is open at a bottom end, and a mount. The mount comprises a base section positioned within the open bottom end of the housing, and adapted to be attached to a lamppost, and a pair of mounting arms extending upwards from the base section within the housing. The mounting arms have lower portions that are generally flat and parallel and have a length direction towards and away from the base and a width direction transverse to the length direction. The mounting arms have upper portions that are generally flat and have a length direction towards and away from the base and a width direction transverse to the length direction. The width directions of the mounting arm upper portions are oblique to one another and the length directions of the mounting arm upper portions are oblique to the mounting arm lower portions. Light sources are mounted on the mounting arm upper portions, facing outwards through a part of the housing that is transparent, obliquely away from each other and obliquely downwards towards the bottom end.

In any of the mentioned devices, the light sources may be arrays of light emitting diodes (LEDs) which may be mounted on circuit boards that are attached flat to the mounting arm upper or distal portions or mounting pads.

The mounting arm upper or distal portions or mounting pads may be arranged generally symmetrically relative to the width direction of the mounting arm proximal portions, and generally symmetrically relative to one another.

The first and second mounting arms may be substantially mirror-symmetrical about a plane extending from the base section between the first and second mounting arms.

The mounting arm proximal portions or lower portions may be generally flat, parallel, and spaced apart. They are then preferably sufficiently far apart for effective convective circulation of air between the mounting arm proximal or lower portions. Such convective circulation can facilitate transfer of heat from the light sources to the luminaire housing, from which it can be dissipated to the external atmosphere.

Middle portions of the mounting arms between the proximal or lower portions and the distal or upper portions may be oblique relative to one another in the same directions as the widths of the distal or upper portions or mounting pads, and may meet at one side edge of the middle portions.

The first and second mounting arms, or the first and second mounting arms and the base section, may be formed as a monolithic component, which may be cast.

At least one exterior surface of the base section facing towards the mounting pads may be curved to direct light from a source of light on one of the mounting pads in a desired direction.

Any of the mentioned luminaires may further comprise a lamppost, on top of which the luminaire may be mounted or mountable.

BRIEF DESCRIPTION OF THE DRAWINGS

The above and other aspects, features, and advantages of the present invention may be more apparent from the following more particular description of embodiments thereof, presented in conjunction with the following drawings. In the drawings.

DETAILED DESCRIPTION OF THE DRAWINGS

A better understanding of various features and advantages of the present methods and devices may be obtained by reference to the following detailed description of illustrative embodiments of the invention and accompanying drawings. Although these drawings depict embodiments of the contemplated methods and devices, they should not be construed as foreclosing alternative or equivalent embodiments apparent to those of ordinary skill in the subject art.

Figure 1:
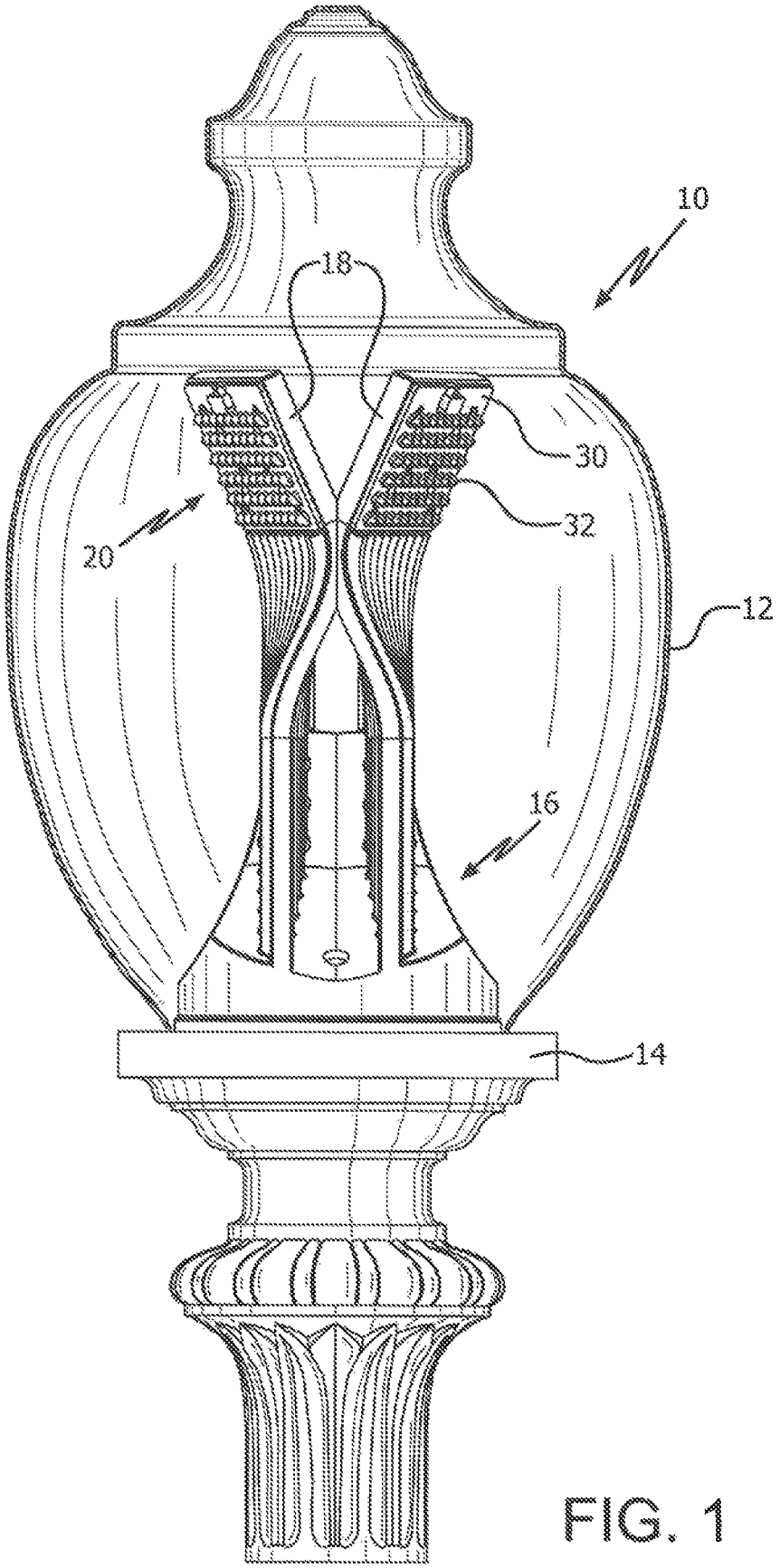
FIG. 1 shows a luminaire assembly according to one embodiment of the invention with a central LED mount.
Figure 3:
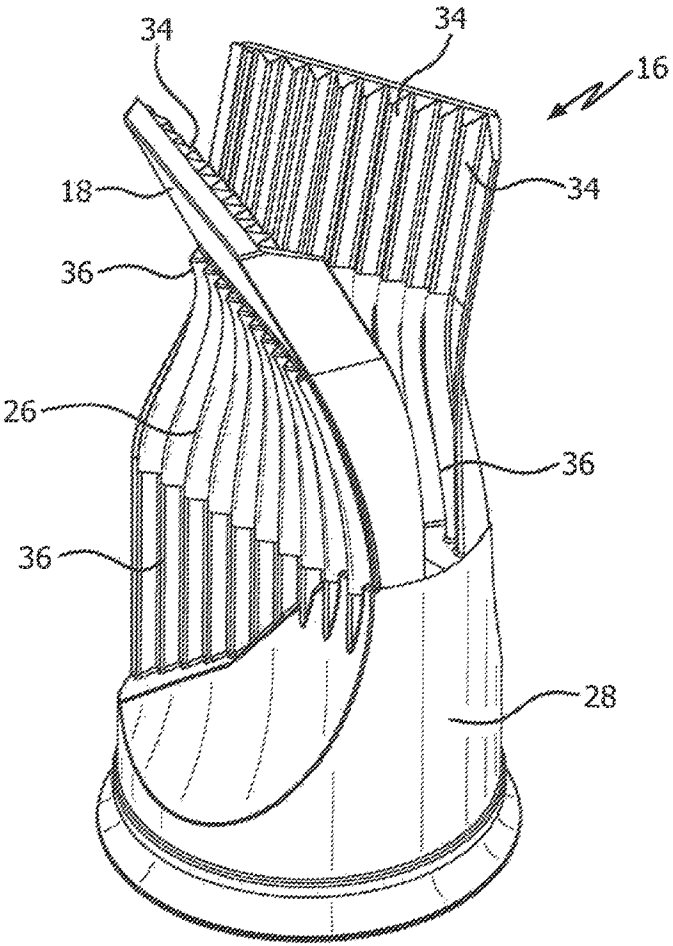
FIG. 3 is a rear perspective view of the LED mount of FIG. 1.
Figure 2:
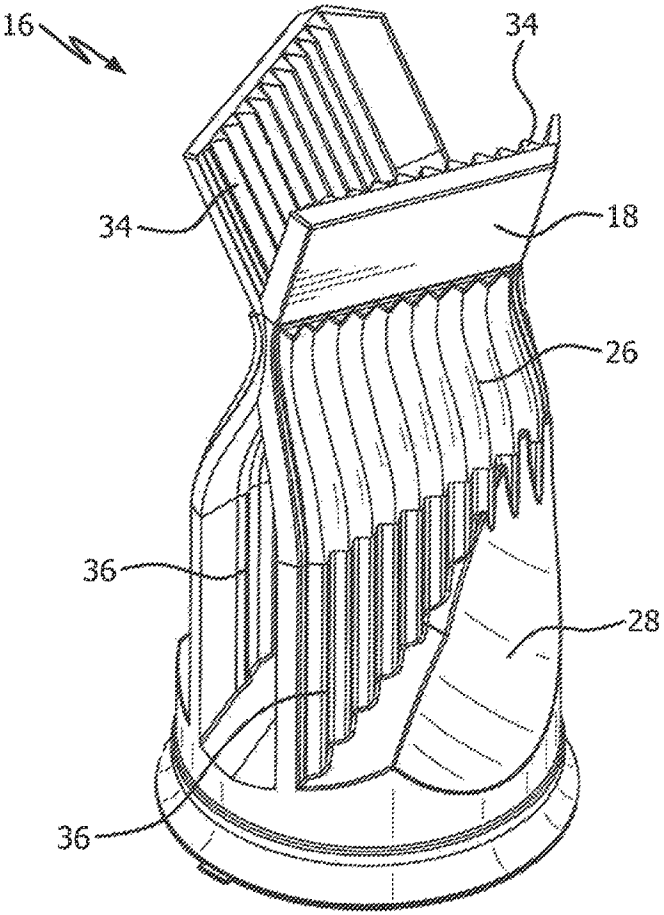
FIG. 2 is a front perspective view of the LED mount of FIG. 1.
Figure 6:
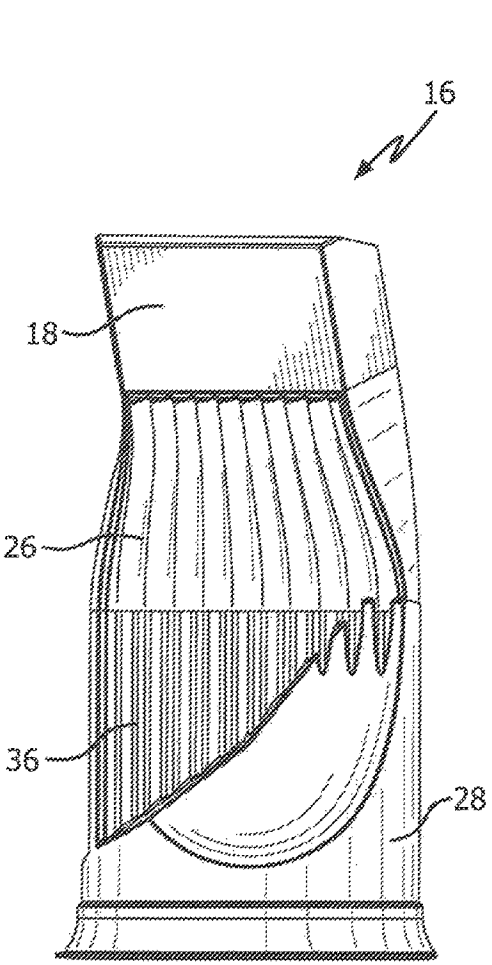
FIG. 6 is a right side view of the LED mount of FIG. 1, the left side view is preferably a mirror image.

Referring to the accompanying drawings, and initially to FIG. 1, one form of light fixture assembly or luminaire embodying aspects of the invention is shown, indicated generally by the reference numeral 10. The luminaire 10 includes a lamp housing or globe 12, which is generically depicted in FIG. 1 only. The globe 12 may be partially or completely transparent or translucent. The globe 12 may be made from glass, plastic, metal or combinations thereof. In an embodiment, the entire housing is made from a one-piece, substantially transparent material, such as a clear stippled polycarbonate material. The globe 12 terminates in an open bottom (not shown) that is configured to sit upon an upper surface of a base 14. The base 14 may be the top of a vertical lamp pole or a connector mount that attaches to the vertical lamp pole. The lamp pole functions as a support for the luminaire, as well as a conduit for channeling wires for supplying power to the luminaire. The details of the lamp pole and base 14 are not pertinent to the present invention.

A central LED mount 16 is located within the globe 12. In the illustrated embodiment, the LED mount is configured to sit upon or mount to the upper surface of the base 14 within the diameter of the open bottom of the globe 12. The LED mount 16 includes at least one, and more preferably two, mounting pads 18 which are configured to provide a mounting surface and support for and to transmit heat from LED light assemblies 20. As shown, the mounting pads 18 are preferably flat surfaces, although other shapes are possible. The mounting pads 18 are each configured to orient an LED light assembly 20 in a prescribed direction with respect to a central axis 22. In the illustrated embodiment, the central axis is perpendicular to a bottom of the LED mount 16, so that when the base 14 is horizontal, the central axis 22 is vertical.

The orientation of the LED light assemblies 20 is selected such that, when powered, the LED light assemblies emit light in a desired direction. In the illustrated embodiment, the pads are configured such that each LED light assembly lies along a plane that is at an angle $\alpha$ with respect to the central axis 22 of the mount 16. In an embodiment, angle $\alpha$ is between about 20 and about 40 degrees. In one preferred embodiment, the angle $\alpha$ is about 25 degrees. In the illustrated embodiment, there are two light assemblies 20 with each oriented at the same angle $\alpha$ but on different sides of the central axis.

The LED light assemblies 20 are also preferably oriented so as to direct light at an angle away from one another. This is best described with reference to FIG. 8 which shows a downward view of the mount 16. In this embodiment, the tops of the pads 18 are each located at an angle $\beta$ in a horizontal plane to a horizontal axis 24, where the angle $\beta$ is between about 20 to about 35 degrees. In one embodiment, the angle $\beta$ is about 20 degrees. The result of the angular orientation of the pads 18 and light assemblies 20 is creation of two pools of light that extend below, in front of, and to either side of the position of the lamp assembly 10.

When used as a street lamp, the lamp 10 is mounted with the "front" direction facing out into and directly across the street, so that the pool of light extends along the street, with little light being thrown backwards into premises behind the lamp.

The angles of the pads 18 are designed so as to direct most of the emitted light from the LED light assemblies 20 into a downward and forward direction. This is particularly beneficial in a luminaire that contains a globe 12 with a transparent or translucent upper portion. By directing the light away from the upper portion, more light is concentrated on the area to be illuminated and less light is lost to the ambient surroundings above the lamp.

Figure 4:
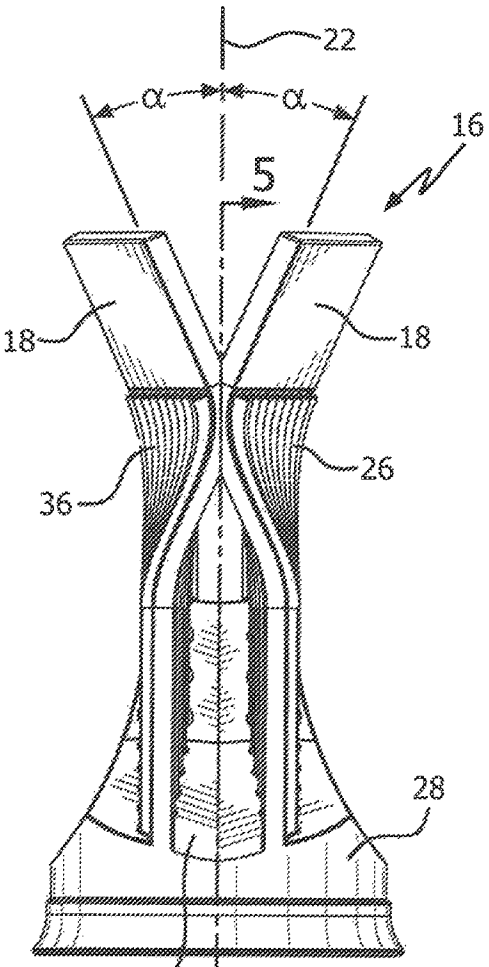
FIG. 4 is a front view of the LED mount of FIG. 1.

As is well understood, LED light assemblies generate a substantial amount of heat during use. It is therefore often desirable to dissipate the heat that is generated. The present embodiment achieves this by using the mount 16 as a heat sink. More particularly, the pads 18 are configured to be in direct contact with the LED light assemblies 20 so as to facilitate conduction of heat to the pads. Each pad 18 is attached to, or more preferably, formed integral with, a transition section 26 of the mount 16. As shown in FIG. 4, the bottoms of the pads 18 and/or the tops of the transition sections 26 may connect with one another, although it is also contemplated that they could remain separate. A greater region of connection between the pads 18 and/or between the transition sections 26 may reduce the efficiency of cooling. At least a portion of each transition section includes a curvature so as to preferably change the orientation of the transition sections in the horizontal plane (corresponding to the angle β of the pads 18) so that lower portions of the transition sections 26 lie along two parallel planes equally spaced from the central axis 22.

Figure 5:
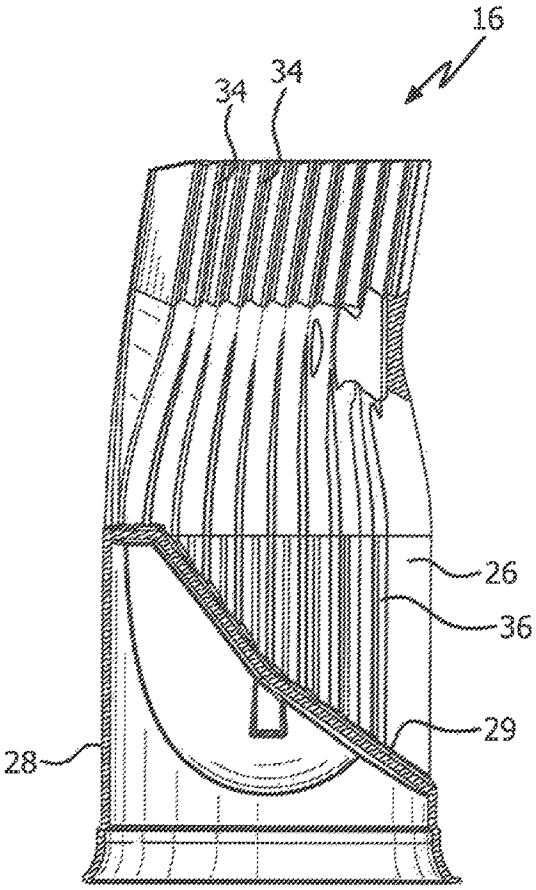
FIG. 5 is a cross-sectional view of the LED mount taken along line 5-5 in FIG. 4.

The transition sections 26 are attached to, or more preferably, formed integral with a common base section 28 of the mount 16. The base section 28 is preferably hollow so as to permit convection of the heat into the air flowing through the central opening in the pole, as well as permit passage of the wiring necessary for powering and/or controlling the LED light assemblies. It is also contemplated that the electrical and electronic circuitry to convert the power delivered by the electrical wiring may be located within the base section 28, or may instead be located within the pole or some other suitable location. The current through each LED may be predetermined, or the brightness may be variable by regulating the current, the number of LEDs powered, or duty cycle modulation. The circuitry may include a time clock, ambient light sensor, or other controls for when and/or how brightly the LED light assemblies are to be illuminated. The circuitry is preferably conventional, and in the interests of conciseness, is not described herein. In the illustrated embodiment shown in cross-section in FIG. 5, the base section 28 may include a sloping top surface 29 that slopes downward from the back to the front of the base section 28. The slope is preferably parabolic in shape so as to increase the light output.

In one embodiment, the entire mount 16 is made from a single-piece casting of aluminum alloy 356F. The use of a single-piece casting permits uninterrupted conduction of heat from the pads 18. This helps to maximize the efficiency of the mount at dispersing heat from the LEDs. Of course, it is also contemplated that the pads 18, transition sections 26 and/or base section 28 could be formed from separate components that are attached to one another, such as through welding, brazing, adhesive or fasteners, although any form of joint will usually reduce the efficiency of the heat sink.

Each LED light assembly 20 preferably includes a printed circuit board 30 with a plurality of LEDs light sources 32 affixed thereto or formed thereon with suitable refractors. The wiring for powering the LEDs preferably passes through a hole in the base section and between the transition sections 26 up to the pads 18. The wires will preferably pass through a strain-relief that will allow the optical chamber to meet an IP66 rating.

In order to further facilitate the dispersion of heat from the LED light assembles 22, the present embodiment contemplates that fin-type surfaces may be formed on or into the pads 18, transition sections 26, and/or the base section 28. More specifically, as shown in FIGS. 2, 3, 5 and 8, fins 34 may be attached to or formed on the back of the pads 18. In the illustrated embodiment, the fins 34 are triangular shaped surfaces that are cast as part of the pads. The triangular shaped material increases the surface area that is exposed to the ambient air and, thus, increases the overall ability of the pads to provide dissipation of heat through convection to the environment. The increased material also reduces the overall temperature of the pads by providing more material for conducting heat to the transition section 26.

The transition section 26 also preferably includes triangular fins 36 on the front and rear. These are shown in FIGS. 3, 4, 5 and 7. As with the fins on the pads 18, the fins 36 on the transition section 26 increase the surface area of the transition section 26, thereby increasing the conduction and convection of heat that occurs during use.

In one embodiment, the luminaire 10 shown in the drawings may be about 42" (1067 mm) high by 16½" (420 mm) in diameter, including the globe 12. The overall dimensions of the LED mount are 17¼" (440 mm) tall with an 8⅞" (225 mm) bottom diameter. The body of the LED mount must fit within an 8½" (215 mm) diameter opening in the globe 12. The LED boards are preferably mounted on a 5½" (135 mm) wide by 4" (100 mm) tall pad 18 with a wall thickness of ½" (12.5 mm) minimum and up to ⅞" (22 mm) at the peak of a rib. These dimensions preferably continue down through the contour of the part. The round base preferably has about a 3/16" (4.5 mm) wall thickness and is sized so that it can house the LED driver.

In another embodiment, the overall dimensions of the LED mount are 13 5/16" (19 mm) tall with an 7⅜" (187 mm) bottom diameter. The remaining dimensions may be generally in proportion, dimensioned to fit within a 7" (178 mm) opening in the globe. The round base preferably still has about a 3/16" (4.5 mm) wall thickness.

One form of suitable LED chips for a street lamp would be CREE XTE or CREE XPL LEDs, with a color temperature of 2200 to 4500 K. The number of LEDs will depend on the power of each LED and on the desired light output. Where the LED light assemblies 20 are flat, and all the LEDs in each light assembly 20 are the same and their lenses are the same, decreasing the number of LEDs, either by switching or by omitting LEDs in manufacture, reduces the overall light output, with minimal effect on the beam shape. For economy of manufacture of a range of products, it is possible to use a single size of circuit board 30 and a common array of LEDs 32. In one embodiment, the CREE LEDs, at 350 mA, provide a total wattage consumed of approximately 120 watts. In the current configuration, 155 watts is the maximum wattage available, and the wattage may be selected to be from about 40 watts to about 155 watts depending on the number of LED's placed. At 120 watts, the unit maintains a solder point temperature of 68 degrees, which means that the heat-sink will effectively manage the watts produced. At 68 degrees, the luminaire will be producing about 90% of its initial lumen output at 41,000 hours.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein.

Figure 8:
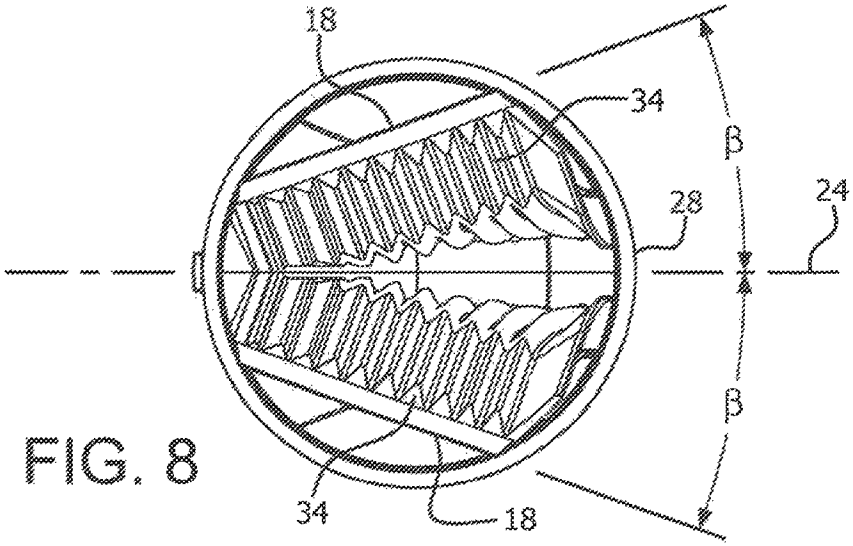
FIG. 8 is a top view of the LED mount of FIG. 1.
Figure 9:
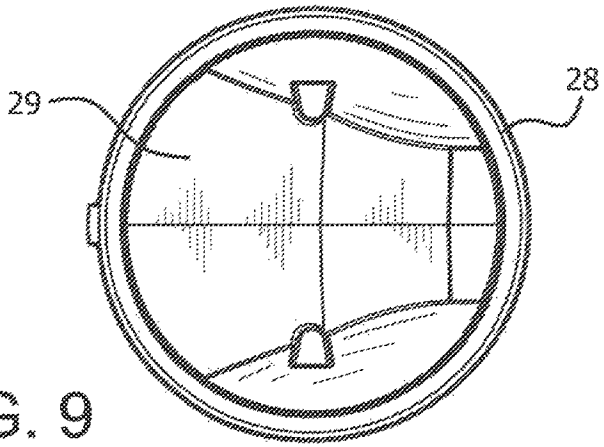
FIG. 9 is a bottom view of the LED mount of FIG. 1.
Figure 7:
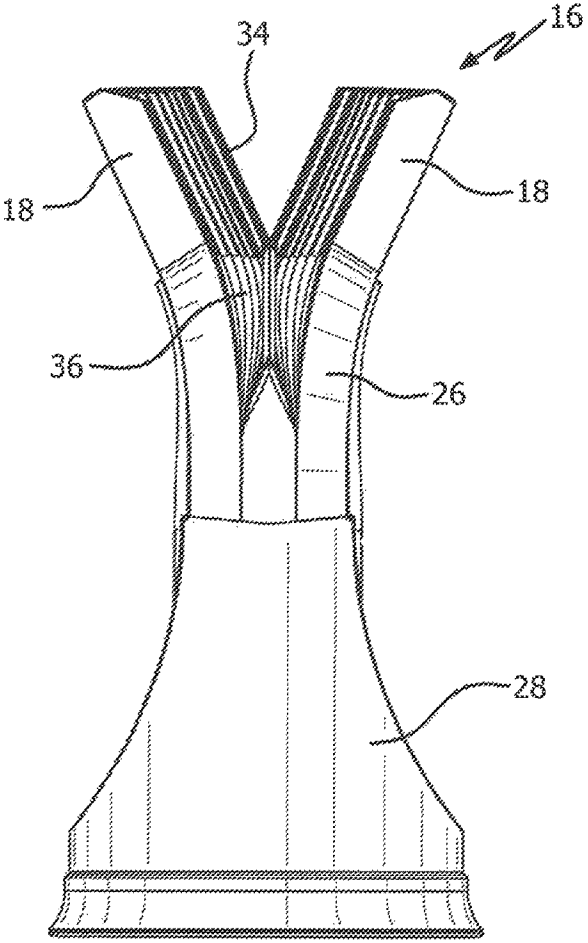
FIG. 7 is a rear view of the LED mount of FIG. 1.

For example, in the interests of simplicity, terms of orientation such as "vertical," "horizontal," and "front" have been used in describing the embodiment, based on the assumption that the central axis 22 shown in FIG. 4 is vertical, the β=0 axis 24 shown in FIG. 8 is horizontal and points forwards and backwards with the side shown in FIG. 4 at the front, and the part of base section 28 and globe 12 that attaches to base 14 is the bottom of luminaire 10. However, the luminaire 10 may of course be used in other orientations and may be shipped or stored in any orientation.

The described embodiment is mirror-symmetrical about the plane containing axes 22 and 24, but the luminaire may instead be asymmetrical, depending on a desired light distribution.

Although an embodiment with two LED light assemblies 20 on the two mounting pads 18 has been described, additional LED light assemblies may be provided. For example, a third LED light assembly may be provided at the rear, if more light is desired directly behind the luminaire than is provided by the overlap of the pools of light from the two LED light assemblies 20.

As shown in the drawings, the lower part of the base section 28 has a flared form to conform to a particular globe 12 and base 14, but other shapes, for example, a step with an O-ring to seal against the globe, may be used.

Although the light assemblies 20 have been described as arrays of light emitting diodes, other light sources may be used, including light sources to be developed in the future.

The LEDs or other light sources may be provided with lenses, mirrors, or other provision to shape the beams of light from the light sources. Such lenses, mirrors, or other provision may be conventional, and in the interests of conciseness is not further described herein.

The invention should therefore not be limited by the above described embodiment, method, and examples, but by all embodiments and methods within the scope and spirit of the invention.

The invention claimed is:

1. A mount for a light assembly in a luminaire, comprising:

a base section;

a mounting section formed integral with and extending from the base section in a length direction;

the mounting section having a proximal portion and a distal portion, the proximal portion being adjacent to the base section and having two outer facing surfaces spaced apart from one another, each outer facing surface lying along a substantially vertical plane, the distal portion of the mounting section curving away from the vertical plane of the proximal portion in at least two directions; and only two respective mounting pads for light sources unitary with or attached to the mounting section distal portion, wherein the mounting pads have length directions towards and away from the base and width directions transverse to the length directions;

wherein the width directions of the mounting pads are oblique to one another, so that mounting surfaces of the mounting pads face obliquely away from each other; and wherein the length directions of the mounting pads are oblique to the length direction of the mounting section proximal portion and oblique to the vertical planes of outer facing surfaces of the proximal portion in at least two directions, so that the mounting pads face obliquely towards the base section, and wherein the mounting section is formed as a monolithic cast component.

2. The mount of claim 1, wherein the mounting pads are arranged generally symmetrically relative to one another.

3. The mount according to claim 1, wherein the mounting pads are substantially mirror-symmetrical about a plane extending from the base section between the mounting pads.

4. The mount according to claim 1, wherein the mounting section and the base section are formed as a monolithic cast component.

5. The mount according to claim 1, wherein at least one exterior surface of the base section facing towards the mounting pads is curved to reflect light from a source of light on one of the mounting pads in a desired direction.

6. The mount according to claim 1, further comprising sources of light on the mounting pads, operative to direct light away from the mounting surfaces of the mounting pads.

7. The mount according to claim 1, in combination with a lamp housing, wherein the mount is inside the housing.

8. The mount in combination with lamp housing according to claim 7, wherein the housing is adapted for mounting on top of a lamppost, with the base of the mount attached to the lamppost and the mounting section extending upwards from the base.

9. The mount according to claim 1, wherein the mounting section has an internal space defined by inner walls, the internal space permitting convective circulation of air through the internal space.

10. The luminaire according to claim 9, wherein walls of the internal space are formed with fins.

11. The luminaire according to claim 10, wherein outer facing surfaces of the mounting section include fins.

12. A luminaire comprising:

a housing that is at least partially transparent and is open at a bottom end;

a mount, comprising:

a base section positioned within the open bottom end of the housing, and adapted to be attached to a lamppost;

a mounting section formed integral with and extending upwards from the base section within the housing;

the mounting section including a lower portion and an upper portion, the lower portion having two outer facing surfaces spaced apart from one another, each outer facing surface lying along a substantially vertical plane, the upper portion of the mounting section curving away from the vertical plane of the lower portion in two directions; and only two light sources, each light source mounted on a mounting arm upper portion attached to an upper end of the upper portion of the mounting section, the mounting arm upper portions being spaced apart from one another, the light sources facing outward toward a part of the housing that is transparent, and obliquely away from each other and obliquely downwards towards the bottom end and oblique to the vertical planes of outer facing surfaces of the lower portion in at least two directions;

wherein the mounting section is formed as a monolithic cast component.

13. The luminaire according to claim 12, wherein the light sources are substantially mirror-symmetrical about a plane extending from the base section between the light sources.

14. The luminaire according to claim 12, wherein the mounting section has an internal space defined by an inner wall, the internal space permitting convection flow of air through the internal space.

15. The luminaire according to claim 14, wherein the walls of the internal space are formed with fins extending in a vertical direction.

16. The luminaire according to claim 15, wherein the outer surfaces of the lower portion of the mounting section are formed with fins extending in a vertical direction.

17. The luminaire according to claim 12, wherein the monolithic cast component further includes the base member.

18. The luminaire according to claim 12, wherein an exterior surface of the base section facing towards the light sources is curved to reflect light from the light sources in a desired direction.

19. A light assembly for a luminaire, comprising:

a base section having a hollow interior cavity and an external wall;

a mounting section formed integral with and extending from the base section;

the mounting section having a length direction towards and away from the base;

the mounting section having a proximal portion and a distal portion, the proximal portion being adjacent to the base section and having two outer facing surfaces spaced apart from one another, each outer facing surface lying along a substantially vertical plane, the distal portion of the mounting section curving away from the vertical plane of the proximal portion in at least two directions;

mounting pads unitary with or attached to the mounting section distal portion, wherein the mounting pads have length directions towards and away from the base and width directions transverse to the length directions; and light sources mounted on the mounting pads;

wherein the width directions of the mounting pads are oblique to one another, so that the light sources face obliquely away from each other and oblique to the vertical planes of outer facing surfaces of the proximal portion in at least two directions; and wherein the mounting section has an internal space defined by interior walls, the interior space configured to permit convective circulation of air through the internal space, and walls of the internal space are formed with ribs extending in a bottom to top direction.

20. The light assembly of claim 19 wherein each light source comprises an array of light emitting diodes, the mounting and orientation of the light sources configured to produce an asymmetrical illumination pattern when the light sources are activated.

21. A luminaire comprising:

a housing that is at least partially transparent and is open at a bottom end;

a unitary cast mount positioned within the housing, the mount comprising:

a base section adapted to be attached to a lamppost; and a mounting section that is formed integral with the base section and extends upward from the base section, the mounting section including a lower portion and an upper portion, the lower portion having two outer facing surfaces spaced apart from one another, each outer facing surface lying along a substantially vertical plane, the upper portion of the mounting section curving away from the vertical plane of the lower portion in at least two directions, the upper portion includes exactly two mounting pads each with a planar surface, the planar surfaces of the mounting pads being on planes that are oblique to one another and oblique to the vertical planes of outer facing surfaces of the lower portion in at least two directions, and are angled downward; and light sources mounted on the mounting pads so as to face downward and outward toward a part of the housing that is transparent, each light source comprising an array of light emitting diodes, the mounting and orientation of the light sources configured to produce an asymmetrical illumination pattern when the light sources are activated.

* * * * *